United States Patent [19]

Trimborn

[11] Patent Number: 4,464,967

[45] Date of Patent: Aug. 14, 1984

[54] ELECTRIC GUITAR HAVING A GUITAR BODY AND A LOUDSPEAKER ATTACHED TO SAID GUITAR BODY

[76] Inventor: Reiner Trimborn, Sieboldstr. 1, 5000 Cologne 60, Fed. Rep. of Germany

[21] Appl. No.: 462,785

[22] Filed: Feb. 1, 1983

[30] Foreign Application Priority Data

Feb. 3, 1982 [DE] Fed. Rep. of Germany ..... 3203844

[51] Int. Cl.[3] ..... G10H 3/18

[52] U.S. Cl. ..... 84/1.16

[58] Field of Search ..... 84/1.04–1.06, 84/1.14–1.16

[56] References Cited

U.S. PATENT DOCUMENTS

| | | | |
|---|---|---|---|
| 2,001,723 | 5/1935 | Hammond, Jr. | 84/1.05 |
| 2,288,463 | 6/1942 | Kislingbury | 84/1.16 |
| 3,194,870 | 7/1965 | Tondreau et al. | 84/1.16 |
| 3,549,775 | 12/1970 | Kaminsky | 84/1.05 |
| 3,612,741 | 10/1971 | Marshall | 84/1.05 |
| 3,730,046 | 5/1973 | Spence | 84/1.05 |
| 3,878,748 | 4/1975 | Spence | 84/1.05 |
| 4,235,141 | 11/1980 | Eventoff | 84/1.16 X |
| 4,312,258 | 1/1982 | Park | 84/1.16 |

FOREIGN PATENT DOCUMENTS

| | | | |
|---|---|---|---|
| 1160069 | 7/1958 | France | 84/1.16 |
| 2001193 | 9/1969 | France | 84/1.16 |

*Primary Examiner*—S. J. Witkowski

*Attorney, Agent, or Firm*—K. S. Cornaby

[57] ABSTRACT

An electrical guitar which includes pick-up means taking up the swinging movements of the strings and converting them into an electric signal, said electric signal being amplified by amplification means and transferred to a loudspeaker fixed to said guitar and an acoustical horn being arranged inside said guitar body and having an entrance opening facing said loudspeaker and a mouth of larger sectional area than the entrance opening forming an opening of said guitar body.

9 Claims, 7 Drawing Figures

ELECTRIC GUITAR HAVING A GUITAR BODY AND A LOUDSPEAKER ATTACHED TO SAID GUITAR BODY

BACKGROUND OF THE INVENTION

1. Field of the Invention

The present invention relates to an electric guitar, and more particularly to a guitar having a loudspeaker attached to its guitar body.

2. The Prior Art

It is known to arrange a loudspeaker in an opening of a top wall of an electric guitar, such that this loudspeaker emits sound waves in the direction normal to the top wall and towards the outside of the guitar, see published German Patent-Application No. 2, 949, 715. Towards the inside of the hollow guitar body the loudspeaker is encapsulated by a cup-shaped absorbing means, prohibiting sound propagation towards the closed inner space of the guitar body.

The known electric guitar comprises a pick-up means arranged close to strings of said guitar, the pick-up means take up mechanical vibrations of the strings and convert them into an electrical signal, which is fed into an input of an electronic amplifier incorporated in the guitar body. An output of said amplifier is connected to the loudspeaker.

Due to the fact, that a guitar body offers only limited space for arranging a loudspeaker in the top wall, the loudspeaker of the known electric guitar has a rather limited diameter and thus a limited frequency response, especially for low frequencies. Furtheron the output of acoustical power and thus the loudness of the known guitar is limited, as the relatively small loudspeaker needs a high driving power, which in turn affords batteries of a rather large capacity in order to have the electric guitar independent from external power sources.

It is thus an object of the present invention, to improve the sound emission of a loudspeaker attached to the guitar body.

It is a further object of the invention to provide an electric guitar having a characteristic "sound", wherein said sound may be modified upon construction of the guitar.

SUMMARY OF THE INVENTION

According to the present invention the electric guitar comprises a hollow and nonresonant guitar body, a guitar neck attached to said guitar body, strings adapted to perform swinging movements, pick-up means taking up the swinging movements of said strings and converting them into an electric signal, said electric signal being amplified by amplification means and transfered to a loudspeaker attached to said guitar body, an acoustical horn being arranged inside said guitar body and having an entrance opening facing said loudspeaker and a mouth of larger sectional area than the entrance opening forming an opening of said guitar body.

According to the invention the sound emission of the loudspeaker is optimized by using an acoustical horn coupled to the loudspeaker. This horn is inside the guitar body and thus does not consume additional space.

According to one advantageous embodiment of the invention the horn is an essential part of the guitar body, advantageously the body is made as enclosure of the horn.

By this arrangement an easy-to-use electrical guitar is provided with the advantage of high acoustic efficiency and low nonlinear distortion. The high efficiency of the horn system allows for the use of small, built-in amplifiers and batteries as power supply of small capacity. Thus the guitar according to the invention may be used without bulky external equipment and consumes less power than known devices. The guitar is handy and portable and may be played anywhere.

According to a further advantageous embodiment of the invention, the sectional area of the divergent horn follows a mathematical function from the horn entrance towards the mouth. The form of the horn may be conical, exponential, parabolic or hyperbolic. To have a long-effective horn with an extended frequency range, the horn is folded along its length. This folding may be done symetrically or asymetrically. By this arrangement a horn is created having an effective length considerably longer than the real length of the guitar body. Furtheron the horn is compact and has a flat construction.

To enhance the acoustic power and to get a special sound by compression distortion, a loudspeaker having a compression chamber is used.

In order to provide for the use of external amplification units, the electric guitar is equipped with a microphone attached to the mouth of the horn. This microphone may be wired to an external amplifier. In this mode the typical horn sound is taken up by the microphone and amplified furtheron.

Figure 1:
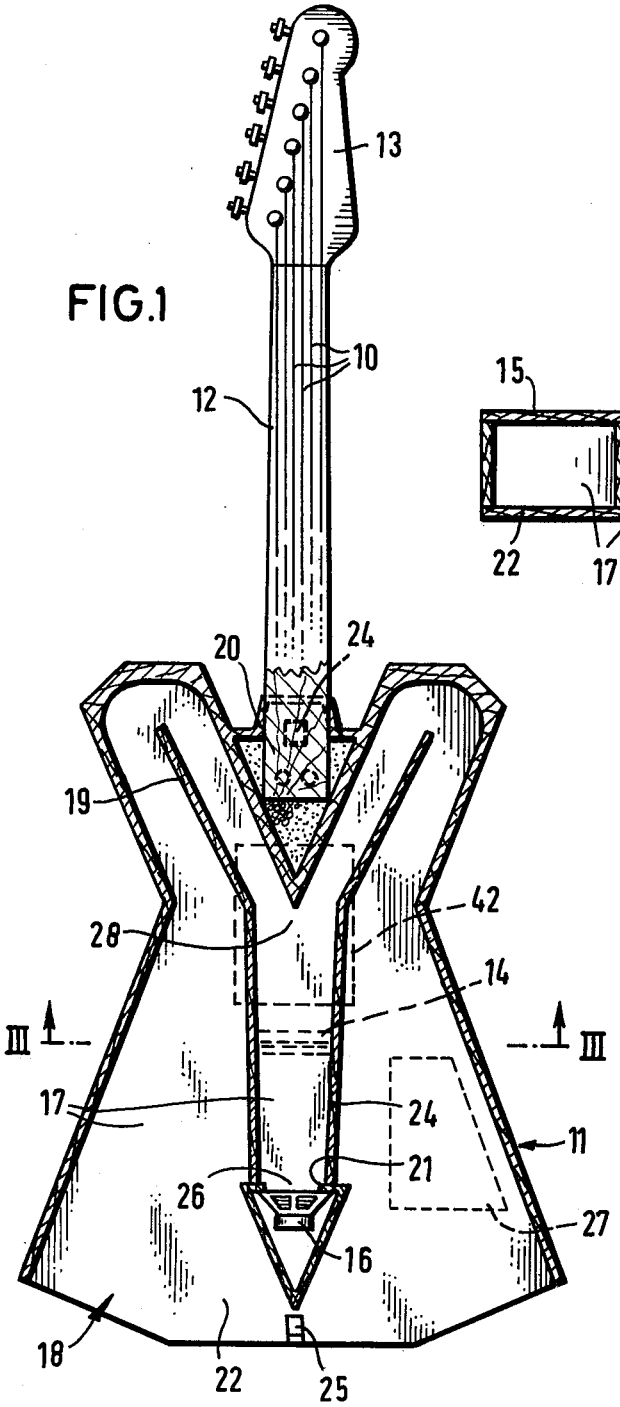
FIG. 1 shows a longitudinal, sectional, top plan view of an electric guitar having a symetrical, folded horn inside the hollow guitar body and a built-in loudspeaker.

The electrical guitar shown in the figures comprises a guitar body 11 and a guitar neck 12 attached to this guitar body 11. Strings 10 are fixed to an area 13 at the free end of the guitar neck 12, these strings 10 perform swinging movements in the known manner if played. In the embodiment shown in FIG. 1 the strings 10 are furtheron fixed at a bridge 14, which is ridgidly connected to the guitar body 11.

The guitar body 11 is hollow and nonresonant, it is defined by a top wall 15, a bottom wall 22 and side walls 23. The hollow space inside the guitar body 11 is formed to be a horn 17, which conducts the sound from the horn entrance 26 to a horn mouth 18 and shows a progressive widening sectional area starting from the entrance 26 towards the mouth 18, i.e. shows a divergence. This gradual opening of the horn 17 follows a mathematical function, the horn 17 may widen conically, exponentially, parabolically or hyperbolically. Each form of widening has its own special advantages in frequency and amplitude behavior and the choice for a special form is a question of the best compromise of physical, mechanical and visual design. To allow for a horn of a longer effective length, the horn 17 is folded back symetrically, as shown in FIG. 1.

Figure 3:
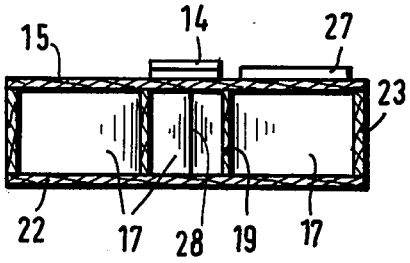
FIG. 3 shows a cross sectional view of the guitar shown in FIG. 1 as seen along line III—III.

A loudspeaker 16 is arranged inside the guitar body 11 near the end of the guitar body 11 opposite to the guitar neck 12. The loudspeaker 16 is intimately connected to the entrance 26 of the horn 17. A first section of this horn 17 starting at the entrance 26 is defined by two inner walls 19 and inner surfaces of the top wall 15 and the bottom wall 22 (see FIG. 3). Adjacent the area, where the guitar neck 12 is fixed to the guitar body 11 and below this area, the horn 17 shows a bifurcation 28, which has the shape of a "V"; after this bifurcation 28 the direction of the horn 17 is reversed, the horn 17 opens towards the end of the guitar body 11 opposite to the guitar neck 12. There the guitar body has a wide, almost rectangular opening, which is the mouth 18 of the horn 17.

Mechanic vibrations, which are produced by moving the strings 10, are taken up by pick-up means 33, located in a pick-up tub 42, and are converted into electric signals, which are fed to an amplifier 27, to which other electronic equipment is associated. For amplification and usual electronic sound effects like "fuzz", "phaser" and "flanger", corresponding electronic equipment is located aside the pick-up tub 42. For energy supply of the electronic equipment batteries are provided in a battery chamber 20. Adjacent to the battery chamber 20 additional electronic equipments 24 may be located.

The horn 17 is directly driven by the loudspeaker 16. In a different embodiment a compression chamber 21 of the loudspeaker is arranged at the entrance 26 for the purpose of increasing the sound pressure. This is performed by narrowing the entrance 26 of the horn 17 or by using a phasing plug.

A microphone 25 is arranged at the mouth 18 of the horn 17 and may be connected to external amplifiers. As seen from FIG. 1, this horn is arranged in the middle of the mouth 18 and near the end of a triangular chamber, in which the sound emission from the rear face of the loudspeaker 16 is extinguished.

Figure 2:
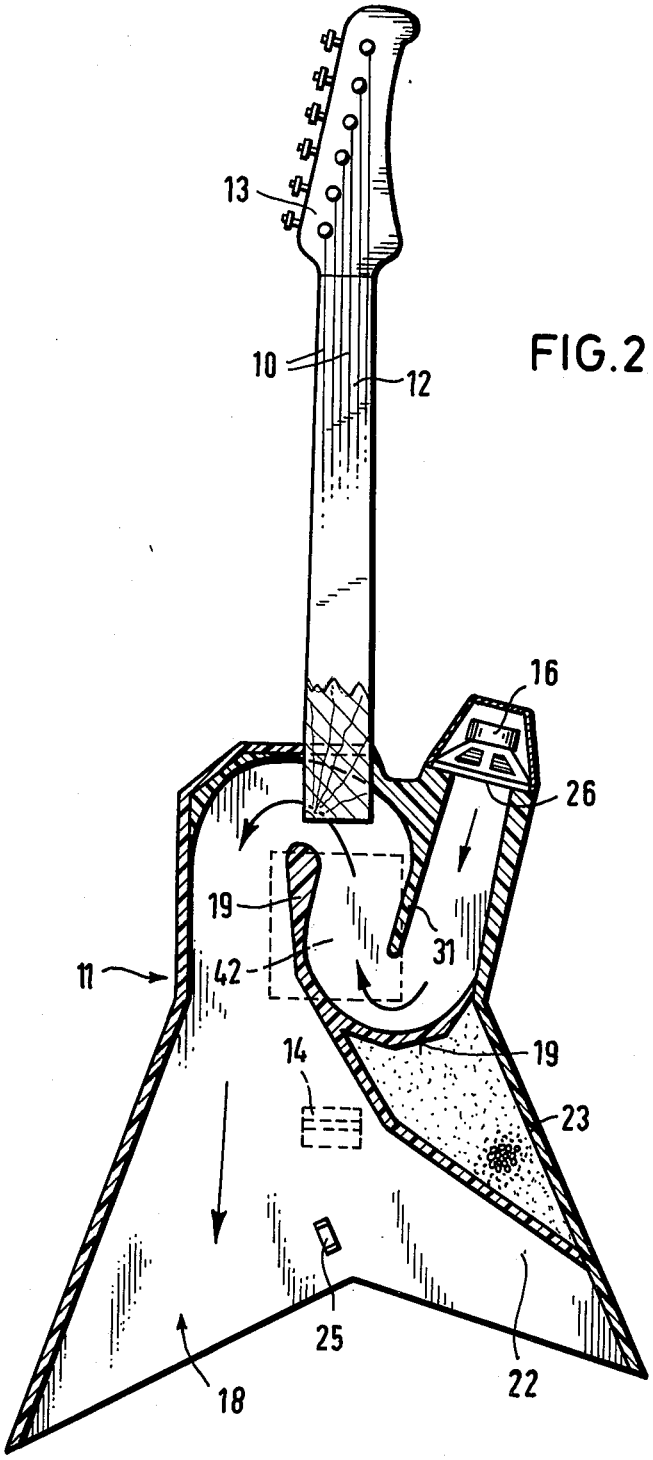
FIG. 2 shows a view as FIG. 1 of a guitar having an asymetrical, folded horn.

FIG. 2 shows an embodiment, in which the horn 17 is asymetrically folded. The loudspeaker 16 is arranged at one side of the guitar neck 12. Sound waves emitted from the loudspeaker are at first directed by a wall 31 and a side wall 23 towards the lower end of the guitar. Near the middle of the guitar body 11 the horn 17 is folded back by 180°, so that the sound waves run towards the guitar neck 12. Below the area, where the guitar neck 12 is fixed to the body 11, the horn 17 is folded a second time, the sound waves are then running towards the mouth 18, which is an opening of the lower side wall 23 of the guitar. A microphone 25 is arranged in the middle of the mouth 18. The way the sound waves take is shown by arrows, starting at the loudspeaker 16 and running towards the mouth 18. The pick-up tub 42 is milled into the top wall 15.

Figure 4A:
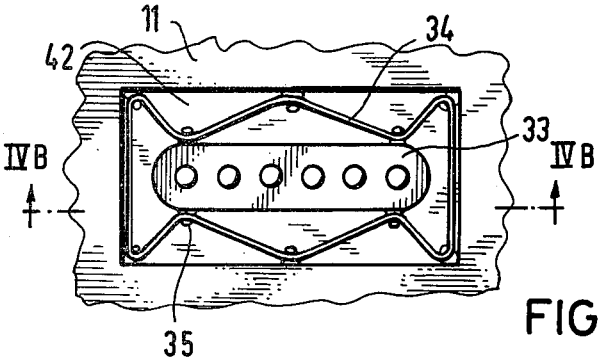
FIG. 4A shows a top view on a pick-up device arranged in an opening of the top wall of the guitar.
Figure 4B:
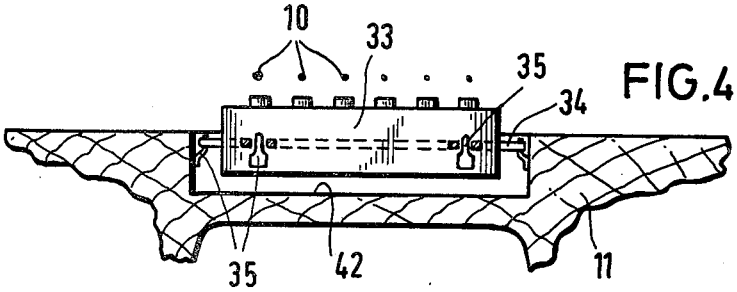
FIG. 4B shows a cross sectional view of the arrangement shown in FIG. 4A as seen along the line IV-B—IVB in FIG. 4A.

FIGS. 4A and B show, how the pick-up means 33 may be fixed to the guitar body 11 (or guitar neck 12, for the embodiment shown in FIGS. 5 and 6, to be discussed later). The pick-up means 33 are hung up cantilever by holding clips 35 in the pick-up tub 42. This attachment is elastical, as the pick-up means 33 is held by a rubber band 34, which blocks propagation of sound waves from the guitar body 11 towards the pick-up means 33. Other embodiments of fixing the pick-up means 33 are possible, i.e. a soft foam between said elements, elastic springs or the like.

Figure 5:
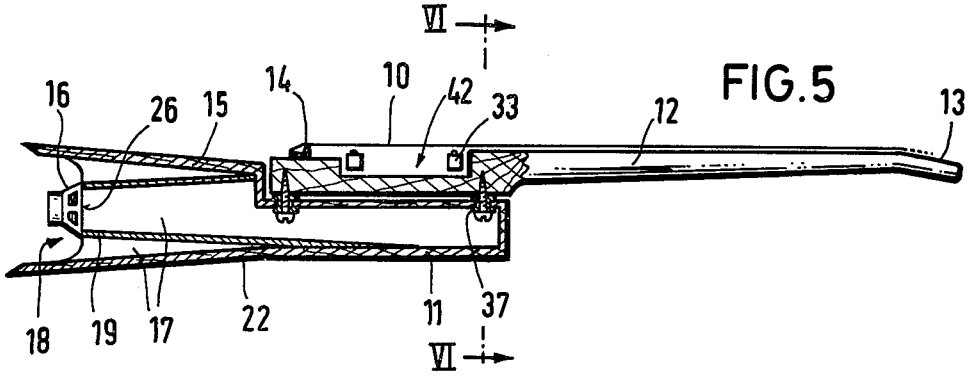
FIG. 5 shows a side elevation, partly in cross section of a guitar having strings fixed to and tightened between two areas of the guitar neck.
Figure 6:
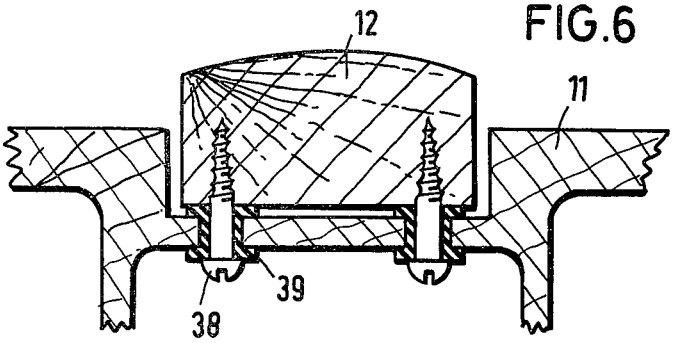
FIG. 6 shows a part of a cross sectional view of the guitar shown in FIG. 5 as seen along the line VI—VI.

In the embodiment shown in FIGS. 5 and 6 the bridge 14 for fixing the strings 10 at the guitar bodies 11 side is fixed near an end of an alongated neck 12, thus the strings 10 are fixed between two areas of the neck 12 and are not fixed to the body 11. Pick-up means 33 are arranged in a tub 42 of the neck 12. The neck 12 is vibrationally isolated from the body 11 by means of silent blocks 37, see FIG. 6. The guitar body 11 includes the loudspeaker 16, the horn 17 with its entrance and its mouth 18.

Thus the sound producing unit and the sound reproducing unit are separated, so that vibrations of the body 11 cannot reach the neck 12 or the pick-up means 33.

As shown in FIG. 6, the guitar neck 12 is fixed by means of screws 38 to the body 11, said screws 38 extend through the silent blocks 37. Other means of attaching the neck 12 to the body 11 are possible, i.e. a layer of foam rubber may be arranged between the two parts 11, 12.

The embodiments described each show a guitar having all functional components incorporated. Thus the guitar may be played at any place and is independent from stationary equipment. The horn 17 requires most of the inside space of the body 11. This horn 17 allows for a new sound in guitar playing.

The guitar may be constructed from wood or other material, a construction in plastic is preferred. Empty spaces like the triangular shaped area in FIG. 2 are filled with foam or the like in order to avoid resonance.

What is claimed is:

1. An electric guitar comprising a hollow and nonresonant guitar body, a guitar neck attached to said guitar body, strings adapted to perform swinging movements, pick-up means taking up the swinging movements of said strings and converting them into an electric signal, said electric signal being amplified by amplification means and transferred to a loudspeaker attached to said guitar body and an acoustical horn being arranged inside said guitar body and having an entrance opening facing said loudspeaker and a mouth of larger sectional area than the entrance opening forming an opening of said guitar body.

2. The electric guitar as set forth in claim 1, wherein the guitar body is formed by walls, the horn being partly defined by inner surfaces of the walls forming said guitar body.

3. The electric guitar as set forth in claim 1, wherein the horn is folded along its length.

4. The electric guitar as set forth in claim 1, wherein the guitar body comprises a top wall and a bottom wall, said top wall and said bottom wall being linked by inner walls defining said horn, a string holder being attached to the outside of said top wall in an area of said top wall, in which at least one inner wall links said area to said bottom wall.

5. The electric guitar as set forth in claim 1, wherein a material obstructing the transmission of soundwaves from the guitar body towards the pick-up means is arranged between said guitar body and said pick-up means.

6. The electric guitar as set forth in claim 1, wherein a microphone is arranged near the mouth of the horn.

7. The electric guitar as set forth in claim 1, wherein the amplification means and a power supply for this amplification means are arranged inside the guitar body.

8. The electric guitar as set forth in claim 1, wherein the strings are fixed to and tightened between two areas of the guitar neck, said guitar neck being connected to the guitar body by means of a material obstructing the transfer of sound waves.

9. The electric guitar as set forth in claim 8, wherein the pick-up means are fixed to the guitar neck, a material obstructing the propagation of sound waves between said pick-up means and said guitar neck being arranged between the pick-up means and the guitar neck.

* * * * *